US010059491B2

(12) United States Patent
Wong

(10) Patent No.: US 10,059,491 B2
(45) Date of Patent: Aug. 28, 2018

(54) LID WITH TWISTABLE SPOUT UNIT AND CONTAINER ASSEMBLY COMPRISING THE SAME

(71) Applicant: AEGIS GLOBAL RESOURCES (HK) LIMITED, Tsuen Wan (HK)

(72) Inventor: Siu Wah Wong, Hong Kong (HK)

(73) Assignee: AEGIS GLOBAL RESOURCES (HK) LIMITED, Hong Kong (CN)

( * ) Notice: Subject to any disclaimer, the term of this patent is extended or adjusted under 35 U.S.C. 154(b) by 0 days.

(21) Appl. No.: 14/984,460

(22) Filed: Dec. 30, 2015

(65) Prior Publication Data

US 2016/0207672 A1 Jul. 21, 2016

Related U.S. Application Data

(60) Provisional application No. 62/104,210, filed on Jan. 16, 2015.

(51) Int. Cl.

| | |
|---|---|
| ***B65D 47/20*** | (2006.01) |
| ***B65D 47/08*** | (2006.01) |
| ***B65D 47/06*** | (2006.01) |
| ***B65D 43/02*** | (2006.01) |

(52) U.S. Cl.

CPC ..... *B65D 47/0857* (2013.01); *B65D 43/0225* (2013.01); *B65D 47/066* (2013.01)

(58) Field of Classification Search

CPC ..... B65D 90/56; B65D 47/0857; B65D 43/0225; B65D 75/16; B65D 47/2018; B65D 83/0066; B65D 47/063; F16K 7/08; F16K 7/06; A47G 19/2272

USPC ..... 222/507, 528, 545, 548, 549, 104, 384, 222/153; 251/4, 212; 383/70

See application file for complete search history.

(56) References Cited

U.S. PATENT DOCUMENTS

| | | | | | |
|---|---|---|---|---|---|
| 1,166,690 | A * | 1/1916 | Kahn | A63H 27/10 | 206/522 |
| 1,431,918 | A * | 10/1922 | Arthur | A45C 13/10 | 222/507 |
| 1,986,484 | A * | 1/1935 | Schlueter | B65D 47/2037 | 222/528 |
| 2,222,083 | A * | 11/1940 | Lintz | B65D 88/26 | 193/25 R |
| 2,663,467 | A * | 12/1953 | Douglass | F16K 7/08 | 222/507 |

(Continued)

*Primary Examiner* — Charles P Cheyney
(74) *Attorney, Agent, or Firm* — Nyemaster Goode P.C.

(57) ABSTRACT

The present invention provides a lid connected to a container, comprising a lid body adapted to be removably attached to the opening of the container, a spout unit comprising a spout and a passage in fluid communication with the spout and with the opening of the container, and a cover member pivotably mounted on the lid body and pivotal between a locked position wherein the cover member acts on the spout unit, thereby causing twistable turning of the passage of the spout unit to prevent a fluid contained in the container from being dispensed through the opening of the container, and an unlocked position wherein the action on the spout unit is released, thereby allowing untwisting of the twisted passage to resume the fluid communication of the passage with the spout and the opening of the container. The invention also provides a container assembly comprising the lid.

20 Claims, 10 Drawing Sheets

(56) References Cited

U.S. PATENT DOCUMENTS

| | | | | | |
|---|---|---|---|---|---|
| 2,846,179 | A * | 8/1958 | Monckton | B65D 90/56 | 222/507 |
| 3,028,896 | A * | 4/1962 | Gooding | B65D 90/56 | 220/300 |
| 3,131,835 | A * | 5/1964 | Nakamura | B65D 47/20 | 222/507 |
| 3,366,363 | A * | 1/1968 | Hogan | F24F 13/065 | 251/4 |
| 3,371,906 | A * | 3/1968 | Lubold | B65D 90/56 | 137/315.01 |
| 3,383,131 | A * | 5/1968 | Rosfelder | E21B 25/06 | 175/240 |
| 5,112,324 | A * | 5/1992 | Wallace | A61F 5/453 | 604/349 |
| 5,203,468 | A * | 4/1993 | Hsu | A47G 19/2272 | 220/254.3 |
| 5,464,189 | A * | 11/1995 | Li | B65D 90/56 | 137/614.14 |
| 9,380,898 | B2 * | 7/2016 | Mason | A47G 19/2272 | |
| 2002/0170874 | A1 * | 11/2002 | Hou | A47G 19/2266 | 215/229 |
| 2005/0082248 | A1 * | 4/2005 | Al-Jadda | B65D 47/2018 | 215/313 |
| 2011/0031277 | A1 * | 2/2011 | Maas | B05B 1/30 | 222/207 |
| 2013/0270307 | A1 * | 10/2013 | Crosby | B65D 47/063 | 222/530 |
| 2015/0034650 | A1 * | 2/2015 | Frolin | B65D 47/2018 | 220/281 |

* cited by examiner

LID WITH TWISTABLE SPOUT UNIT AND CONTAINER ASSEMBLY COMPRISING THE SAME

FIELD OF THE INVENTION

This invention relates generally to a lid design for use in a container, and in particular a lid comprising a spout unit that can be closed or blocked by twistable turning. This invention also relates to a container comprising such a lid.

BACKGROUND OF THE INVENTION

Lids or covers for covering an opening of a container comprising a mechanism to close or block a liquid passage connecting the inside of the container to the outside of the container are currently available. There are different ways of closing and opening the liquid passage such as a tube, as described in US2010/0181329A1, U.S. Pat. Nos. 8,602,238B2, 8,622,237B2, US1120025332, U.S. Pat. Nos. 5,203,468, 5,273,172, 5,332,131, 5,897,013, 6,279,773, 6,523,711, 6,609,624, 6,745,949, US20050029271 and EP1095599, etc.

In some of these lids or covers, the liquid passage is closed or blocked by bending or folding the liquid passage, which may be known, for example from US2010/0181329A1 and U.S. Pat. No. 8,602,238B2. A disadvantage of these types of lids or covers is that as the liquid passage is closed by bending or folding the tube or the spout which forms the liquid passage, an extra space needs to be provided in order to accommodate the bent tube or spout.

In some other lids or covers, the liquid passage is blocked by misaligning an upper portion of the liquid passage with a lower portion of the liquid passage. For example, U.S. Pat. No. 8,622,237B2 teaches this arrangement, in which the inlet 156 of the mount 100 is pivoted away from the inlet 80, the fluid conduit 74 is blocked. When the inlet 156 is pivoted to align with the inlet 80, the fluid is allowed to flow through the entire fluid conduit. U.S. Pat. Nos. 3,881,643 and 5,337,918 disclose the similar mechanism of closing and opening the liquid passage. This type of lids and covers has the disadvantage of being complicated in structure as a result of the mechanism responsible for the misalignment present.

Therefore, there is a need for a lid assembly that is both space saving and simple in structure.

SUMMARY OF THE INVENTION

The present invention has a principle object of providing a lid used for a container comprising a spout unit that can be closed or blocked by twistable turning, instead of by way of being bent or being misaligned. Another object of the present invention is to provide a container comprising such a lid.

This and other objects are satisfied by the present invention, which provides a lid connected to a container for covering an opening of the container, comprising:

a lid body adapted to be removably attached to the opening of the container, a spout unit comprising a spout and a passage in fluid communication with the spout and with the opening of the container, wherein the spout unit is mounted such that at least a part of the spout protrudes beyond the lid body and the passage is disposed in the lid body, a cover member movable between a locked position wherein the cover member acts on the spout unit, thereby causing twistable turning of the passage of the spout unit to prevent a fluid contained in the container from being dispensed through the opening of the container, and an unlocked position wherein the action on the spout unit is released, thereby allowing untwisting of the twisted passage to resume the fluid communication of the passage with the spout and the opening of the container for dispensing the fluid.

Preferably, the cover member is pivotably mounted on the lid body and pivotal between the locked position and the unlocked position. It would be appreciated that the cover member may be detachably mounted on the lid body, for example, by screws, snap-fit or any other methods known in the art.

In one embodiment of the present invention, the cover member is configured to act on the spout unit by pressing downwardly against the spout unit. The lid further comprises a guiding unit configured to guide the twistable turning of the passage when the spout unit is pressed downwardly. The guiding unit may be secured to a bottom portion of the passage and configured for guiding to rotate the spout about an axis thereof downwardly to activate the twistable tuning of the passage.

In one preferred embodiment of the invention, the guiding unit may comprise a hollow cylinder with opened top and bottom ends, and a collar having an upper section coupled to a bottom of the cylinder and a lower section secured to the bottom portion of the passage. The collar has at least one positioning element on an inner surface of the upper section and received in a notch formed in the bottom of the cylinder, and at least one positioning block on an inner surface of the lower section and engageable with a respective slot formed on the bottom portion of the passage. Further, the collar has internal threads for mating engagement with corresponding threads formed on an outside of the bottom of the cylinder and an outside of the bottom portion of the passage.

In another embodiment of the invention, a ring member may be sleeved onto a lower portion of the spout of the spout unit. Interfitting male and female coupling elements are formed respectively on an inner surface of the cylinder of the guiding unit and on an outer surface of the ring member for guiding the downward rotation of the spout. In some cases, the interfitting male and female coupling elements comprise a guiding slot or a guiding step formed on the inner surface of the cylinder of the guiding unit, and at least one bulge formed on the outer surface of the ring member and movably received in the guiding slot or resting on the guiding step. In one embodiment of the invention, two bulges are formed opposite to each other on the outer surface of the ring member.

Preferably, the guiding slot or the guiding step is formed spirally and circumferentially on the inner wall of the cylinder of the guiding unit, such that when the cover member acts on the spout unit, the bulge is guided to move downwardly along the guiding slot or the guiding step to rotate the spout, and the rotation of the spout in turn causes the twistable turning of the passage of the spout unit.

According to the invention, the passage of the spout unit may be made of an elastic material such as silica gel, and the elasticity of the material allows the untwisting of the twisted passage when the action on the spout unit is released.

In one particular embodiment of the invention, the lid body comprises an outer portion, and an inner portion coaxially arranged with the outer portion and having a window formed therethrough for receiving and engaging with a part of the cylinder of the guiding unit, with the spout of the spout unit protruding beyond the window. At least one recess is formed on the cylinder of the guiding unit to cooperate with at least one corresponding protrusion formed on the inner portion of the lid body so as to prevent the guiding unit from rotating relative to the lid body.

According to the invention, a locking unit is pivotally mounted on the lid body for locking the cover member in the locked position when the locking unit is engaged with the cover member and unlocking the cover member when the locking unit is disengaged from the cover member. In one preferred embodiment of the invention, the locking unit comprises a locking block engageable with a locking seat formed on the cover member for locking the cover member in the locked position, an operation panel extending laterally from an end of the locking block, and a stub extending from a side surface of the operation panel for holding a compression spring, wherein application of a pressure to the operation panel enables the locking block to move inward so as to disengage the locking block from the locking seat of the cover member.

Another aspect of the present invention provides a container assembly comprising a container and a lid of the present invention.

To have a better understanding of the invention reference is made to the following detailed description of the invention and embodiments thereof in conjunction with the accompanying drawings.

BRIEF DESCRIPTION OF THE DRAWINGS

In the various figures of the drawings, like reference numbers are used to designate like parts.

DETAILED DESCRIPTION OF THE PREFERRED EMBODIMENTS

Figure 1:
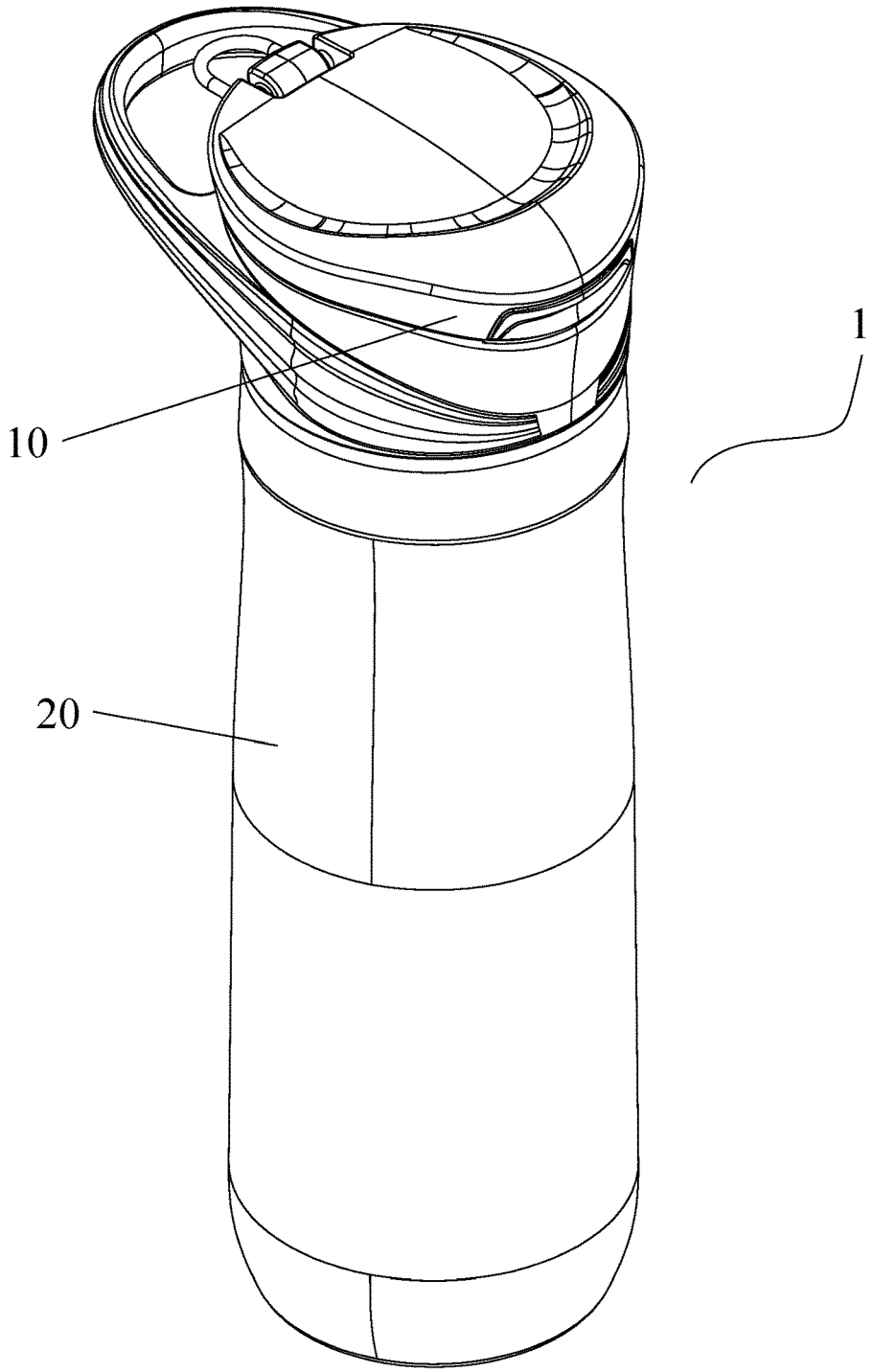
FIG. 1 is a perspective view of a container assembly with a lid constructed according to an embodiment of the present invention in the locked position.

While this invention is illustrated and described in a preferred embodiment, the lid of the present invention and the container assembly comprising the lid may be produced in many different configurations, sizes, forms and materials.

Referring now to the drawings, FIGS. 1 to 10 illustrate a lid constructed consistent with a preferred embodiment of the invention and a container member having the lid placed thereon. The container assembly 1 comprises a container 20 having a top opening 21 (see FIG. 3), and a lid 10 connected to the container 20 for covering the top opening 21. The container 20 is used to contain or store contents such as liquid and may be of any type known in the art. The lid 10 comprises a lid body 11, a spout unit 30 mounted in the lid body 11, and a cover member 40 pivotally mounted on the lid body 11.

Figure 3:
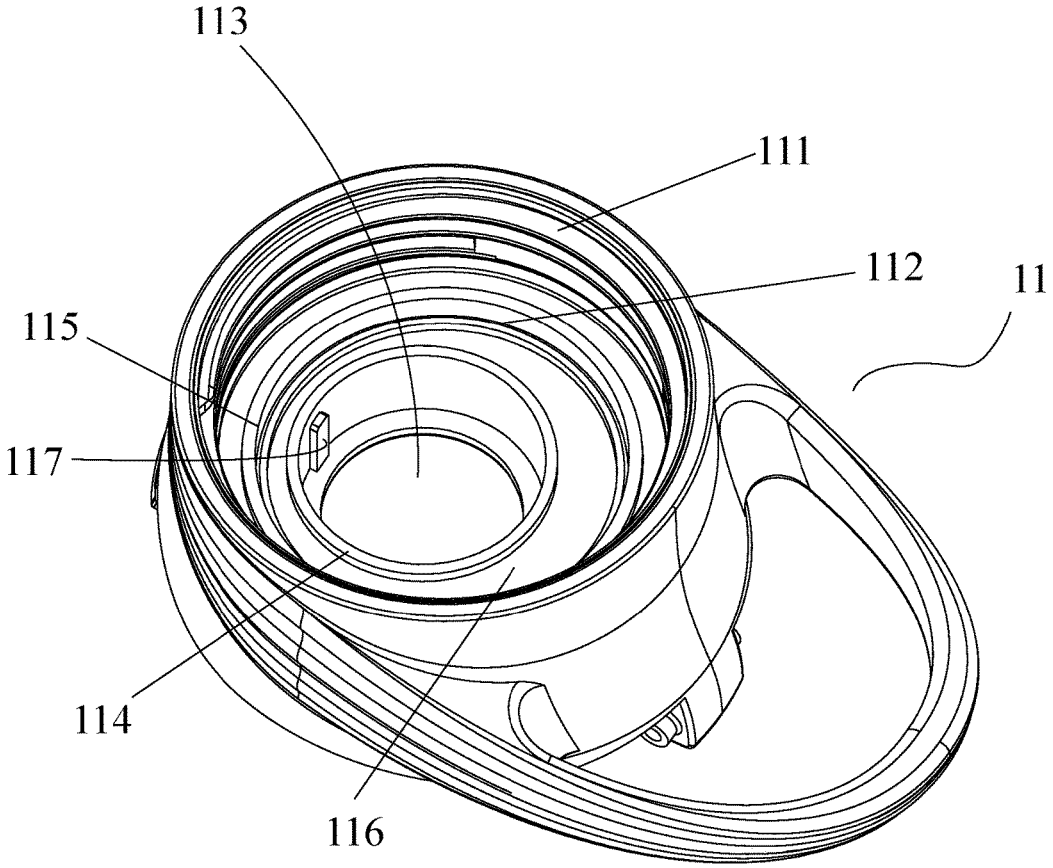
FIG. 3 is a perspective bottom view of a lid body of the lid

The lid body 11 is adapted to be removably attached to the opening 21 of the container 20. As shown in FIG. 3, the lid body 11 comprises an outer portion 111, and an inner portion 112 coaxially arranged with the outer portion 111 and having a window 113 formed therethrough. The outer potion 111 and the inner portion 112 are molded integrally from, for example, a plastic material. The window 113 is provided to receive and engage with a guiding unit 50, which will be discussed hereinbelow. The inner portion 112 of the lid body 11 comprises a first portion 114 of small diameter and a second portion 115 of large diameter. A stage 116 connects the first portion 114 to the second portion 115. The first portion 114 has at least one longitudinal protrusion 117 formed on an inner wall thereof. The second large diameter portion 115 has internal threads for mating engagement with corresponding threads formed on an outside of the opening 21 of the container 20.

Figure 6:
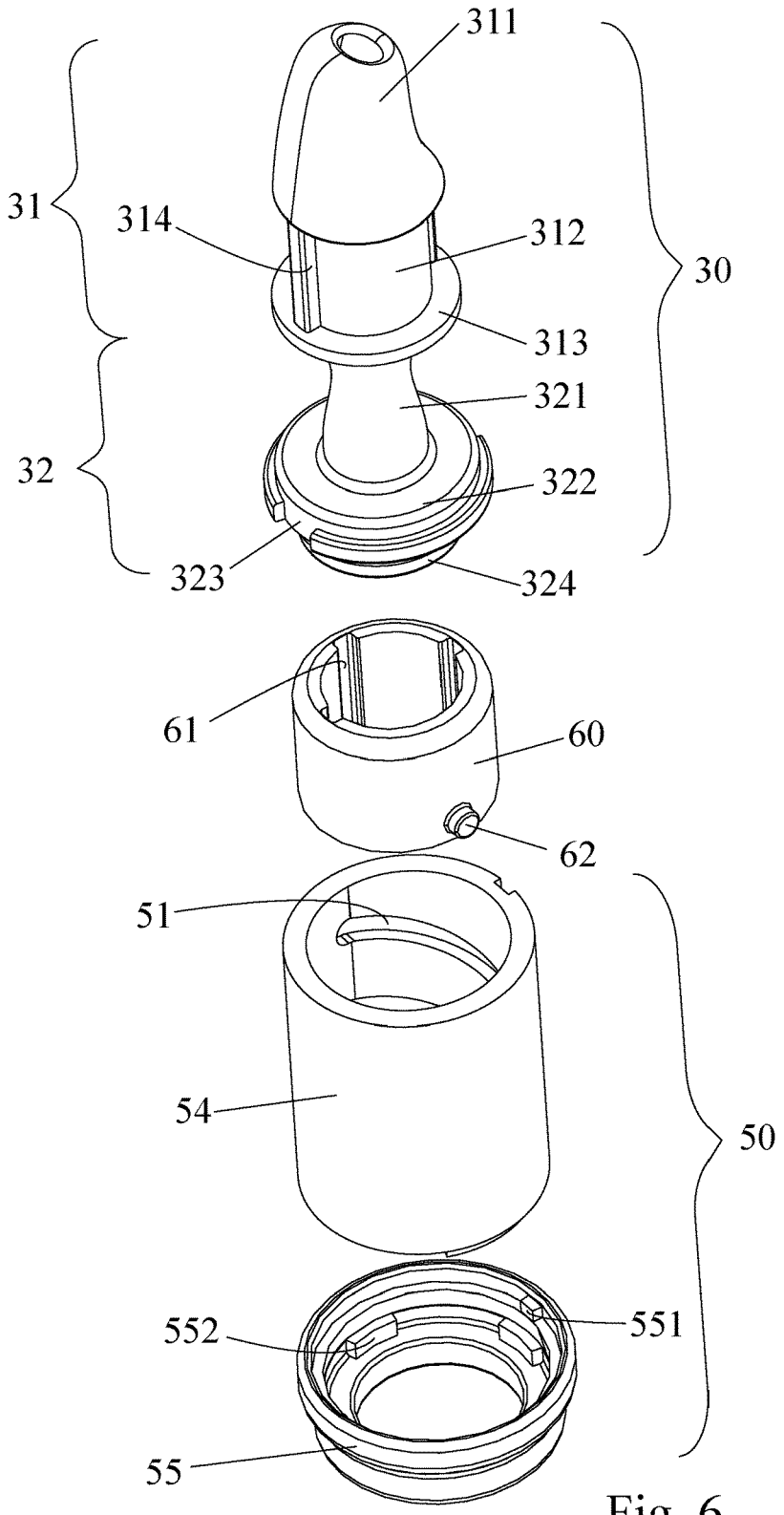
FIG. 6 is an exploded view of the spout unit and the guiding unit.
Figure 8:
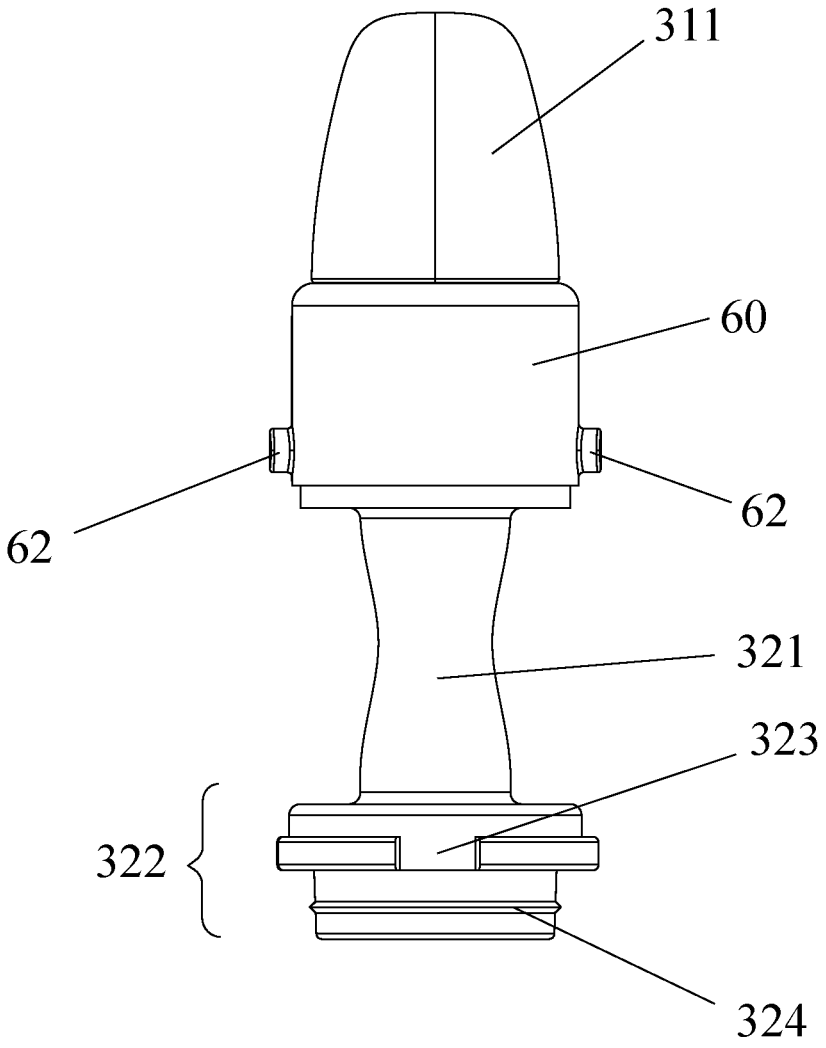
FIG. 8 is a front elevation view of the spout unit with a ring member.
Figure 9:
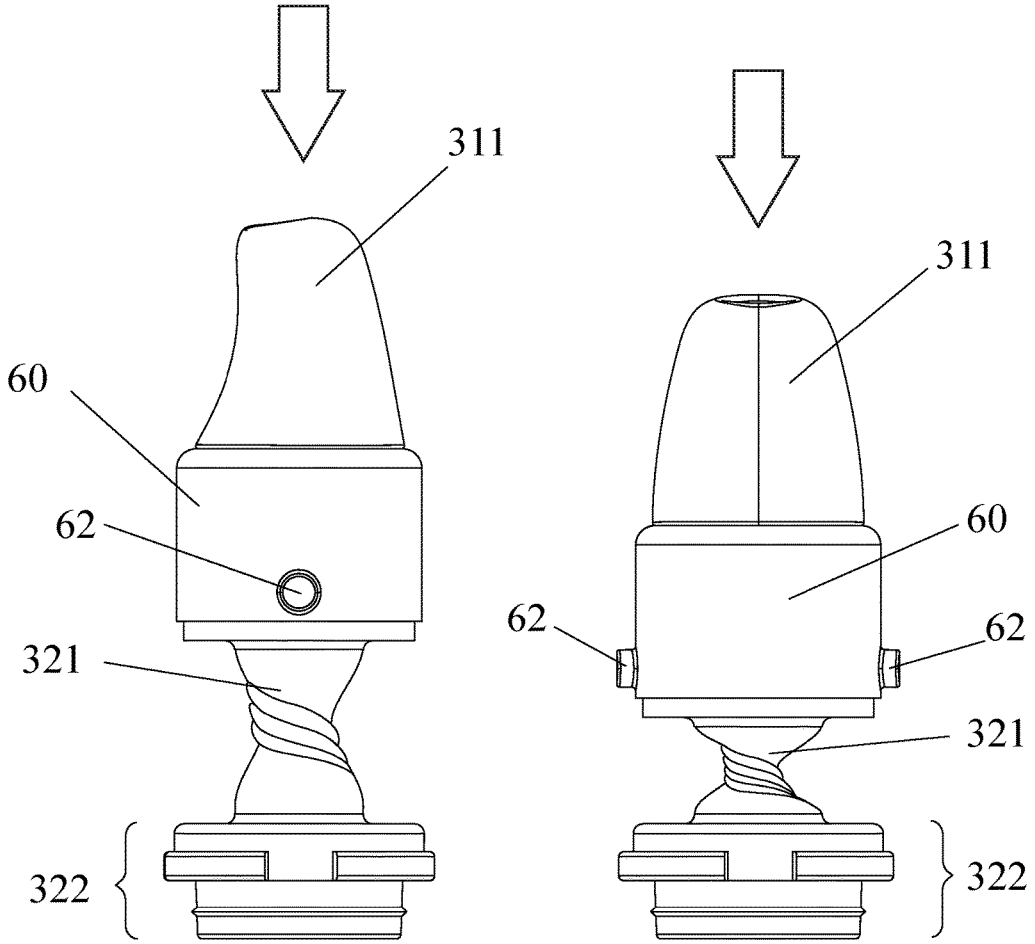
FIG. 9 is a schematic diagram showing the twistable turning of the spout unit.

Now turning to FIGS. 6 and 8, there is illustrated the spout unit 30 which comprises a spout 31 and a passage 32 in fluid communication with the spout 31 and in fluid communication with the opening 21 of the container 20 for allowing the liquid contained in the container 20 to flow out of the container 20 through the spout 31. In this embodiment, the spout unit 30 is made from an elastic material like silica gel and provided as one piece. The spout 31 comprises a nipple 311 and a lower portion 312 extending from the nipple downwardly and having a bottom flange 313 and two opposite ribs 314. The passage 32 comprises a tube 321 and a lower portion 322 extending downwardly from the tube. On an outer surface of the lower portion 322 of the passage is formed a plurality of slots 323. The bottom 324 of the lower portion 322 has threads on the outside thereof. The spout unit 30 mounted such that the nipple 311 protrudes beyond the lid body 11, and the lower portion 312 of the spout 31 and the passage 32 are disposed inside the lid body 11.

A ring member 60 is sleeved onto the lower portion 312 of the spout 31 and carried on the flange 313. The ring member 60 may be made with the same elastic material of the spout unit 30. As illustrated, two opposite troughs 61 are provided inside the ring member 60 to receive the respective ribs 314 of the spout 31. This will prevent movement of the ring member 60 relative to the spout 31. It would be appreciated that the ring member 60 may be formed integrally with the spout 31. The ring member 60 is also provided with a pair of bulges 62 formed on opposite sides thereof. The bulges 62 are able to move downwardly when the cover member 40 acts on the spout unit 30. The movement of the bulges 62 would drive the twistable tuning of the passage 32 because the bottom portion 321 of the passage 32 is fixed to the guiding unit 50. This will be discussed hereinbelow.

In this embodiment, a guiding unit 50 is provided to couple to the spout unit. As illustrated in FIGS. 5, 6, 7*a* and 7*b*, the guiding unit 50 is secured to lower portion 322 of the passage 32 and configured for guiding the downward rotation of the spout 31 about a central axis of the spout. In this embodiment, the guiding unit 50 comprises a hollow cylinder 54 with two open ends and a collar 55 having an upper section coupled to a bottom of the cylinder 54 and a lower section secured to the bottom 324 of the passage 32.

As illustrated in FIG. 6, the collar 55 has a positioning element 551 and internal threads on an inner surface of the upper section thereof. The positioning element 551 is snugly received in a notch 541 formed in the bottom of the cylinder (54), and the internal threads are in mating engagement with corresponding threads formed on an outside of the bottom of the cylinder 54, so that the collar 55 are coupled to the cylinder 54. The collar further has a plurality of positioning blocks 552 and internal threads on an inner surface of the lower section thereof. The positioning blocks 552 are engageable with respective slots 323 formed on the bottom portion 322 of the passage 32, and the internal threads are in mating engagement with corresponding threads formed on an outside of the bottom 323 of the passage 32, so that the collar 55 are firmly connection to the passage 32 of the spout unit 30 (see FIG. 5). Because of this firm connection, the bottom 323 of the passage 32 of the spout unit remains immobile during the process of the downward rotation of the spout 31, which in turn causes the twistable turning of the passage to block the outflow or dispensing of the liquid in the container 20.

Figure 7A:
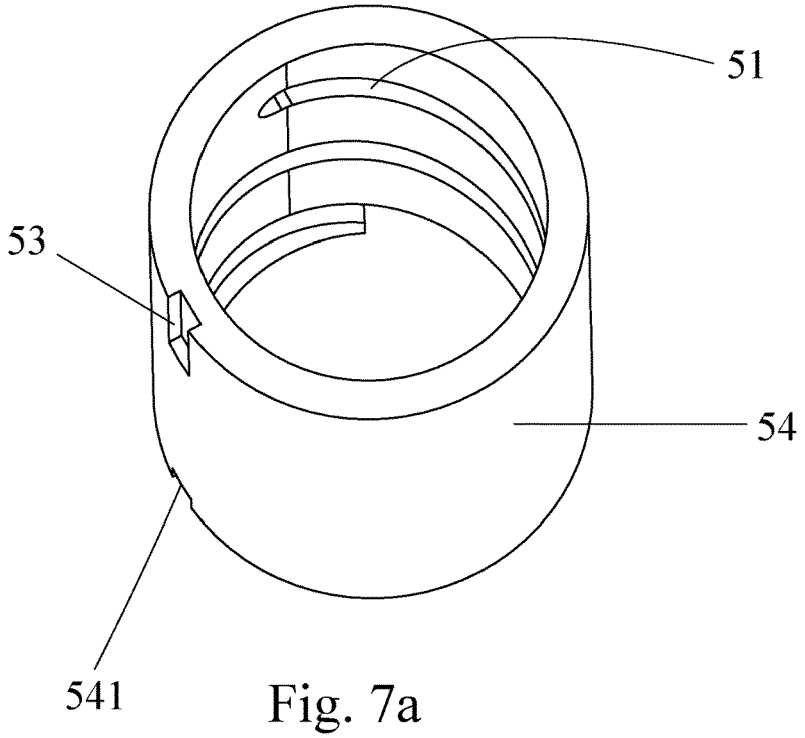
FIG. 7*a* is a perspective top view of a cylinder of the guiding unit.
Figure 7B:
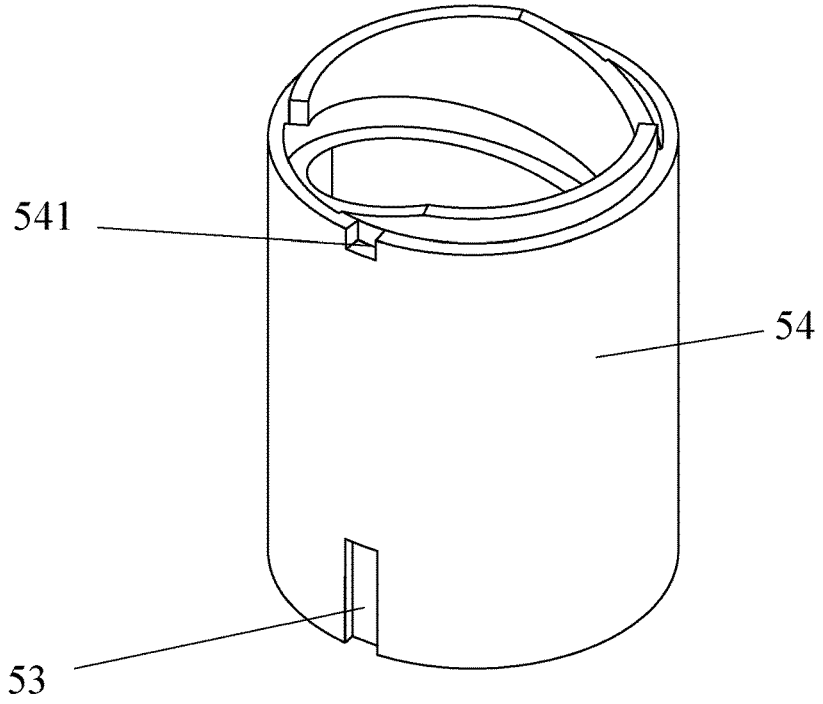
FIG. 7*b* is a perspective bottom view of the cylinder shown in FIG. 6*a*.

FIGS. 7*a* and 7*b* illustrate top and bottom views of the cylinder 54 of the guiding unit 50. A spiral guiding step 51 or a spiral guiding slot is formed circumferentially on the inner wall of the cylinder 54. The cylinder 54 further comprises at least one longitudinal recess 53 formed on an upper portion thereof. This recess 53 would cooperate with the respective longitudinal protrusion 117 of the inner portion of the lid body, thereby preventing the rotation of the guiding unit 50 relative to the lid body 11. The stage 116 of the inner portion of the lid body 11 is sized in diameter such that the guiding unit 50 is secured between the lid body 11 and the top of the opening 21 of the container 20.

Figure 2:
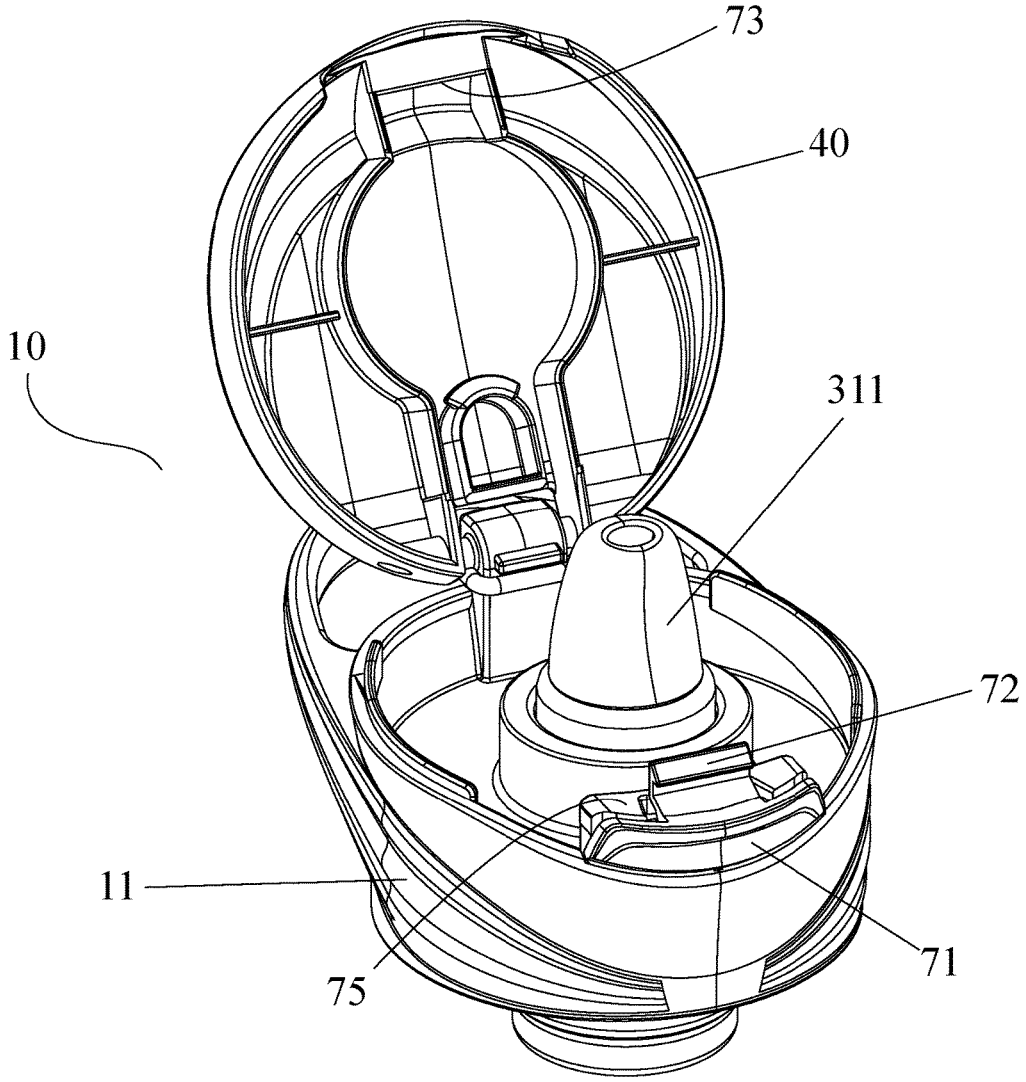
FIG. 2 is a perspective view of the lid shown in FIG. 1 in the unlocked position.

The cover member 40 is pivotably mounted on the lid body 11 as shown in FIG. 2. The cover member 40 is configured to be pivotal between a locked position and an unlocked position. In the locked position, the cover member 40 is locked on the lid body 5 and acts on the spout 31 of the spout unit 30 which is pressed to move downwardly according to an arrow shown in FIG. 9. In the unlocked position, the cover member 40 pivots away from the spout 31 and thus the action on the spout 31 is released.

The two bulges 62 of the ring member 60 are movably resting on the spiral step 51 or received in the spiral guiding slot of the cylinder 54, such that when the cover member 40 in the locked position presses downwardly against the spout 31, the bulges 62 are forced and guided to move downwardly along the spiral step 51, which in turns drives the downward rotation of the spout 31. Because the bottom portion 322 of the passage 32 is fixed to the guiding unit 50 and thus immobile, twistable turning of the tube 321 takes place during the downward rotation of the spout 31, with a result that the tube 321, namely the fluid communication of the tube with the opening 21 of the container, is blocked to prevent the fluid contained in the container 20 from being dispensed through the opening 21, as clearly shown in FIG. 9. When the cover member 40 is switched into the unlocked position, as shown in FIG. 2, the downward force applied on the spout 31 is released, the twisted passage 32 would be able to become untwisted due to the material elasticity of the passage 32, and at the same time the bulges 62 would move upwardly along the spiral step 51 or the spiral slot. In this case, the fluid communication between the passage 32 with the spout 31 and the opening 21 of the container resumes, thereby allowing the liquid contained in the container 20 to flow through the passage 32 and the spout 31. The container is in ready-to-use state for dispensing the liquid.

The unique twistable configuration of the spout unit 30 of the invention not only prevents undesired outflow, dispensing or leakage of the liquid contained in the container 20 when it is not in use, but also provides a simple and convenient way of switching the lid between a closed position and an open position.

Figure 4:
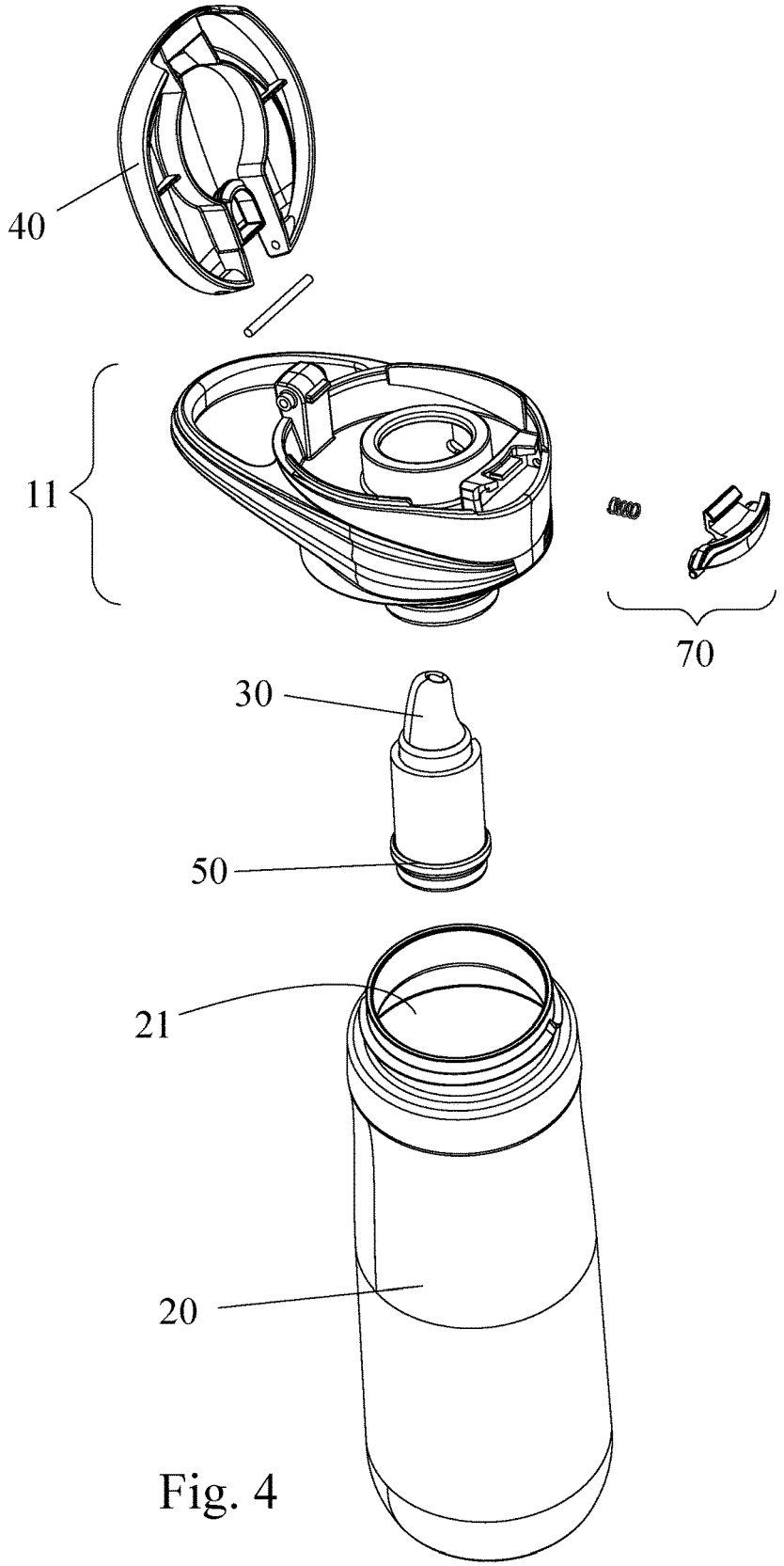
FIG. 4 is an exploded view of the container assembly shown in FIG. 1.
Figure 5:
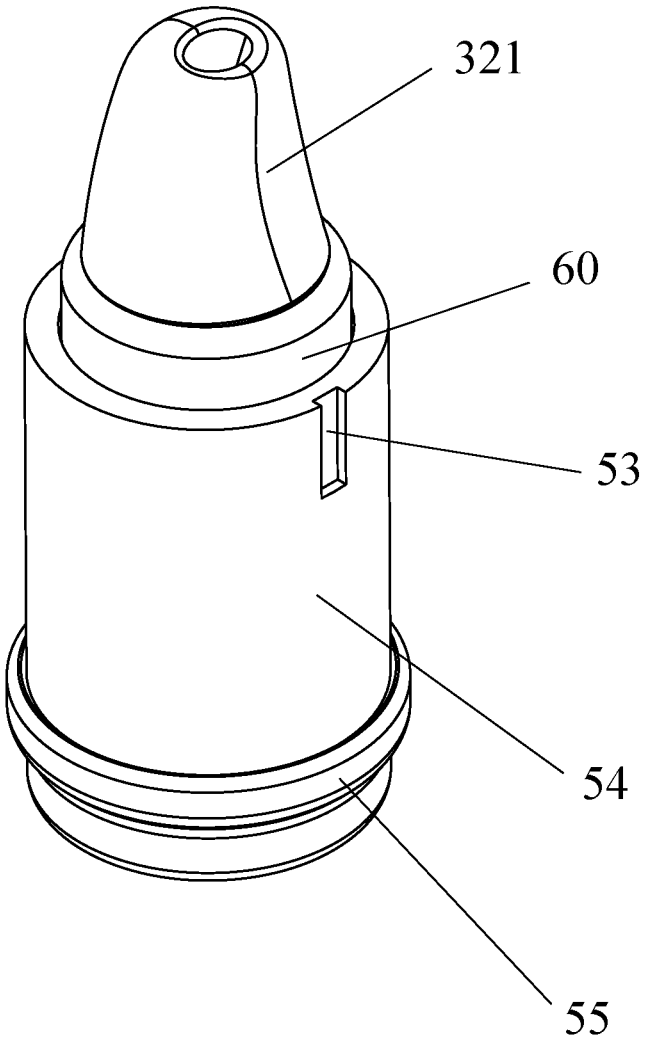
FIG. 5 is a perspective view of a spout unit and a guiding unit of the lid in the assembled state.
Figure 10:
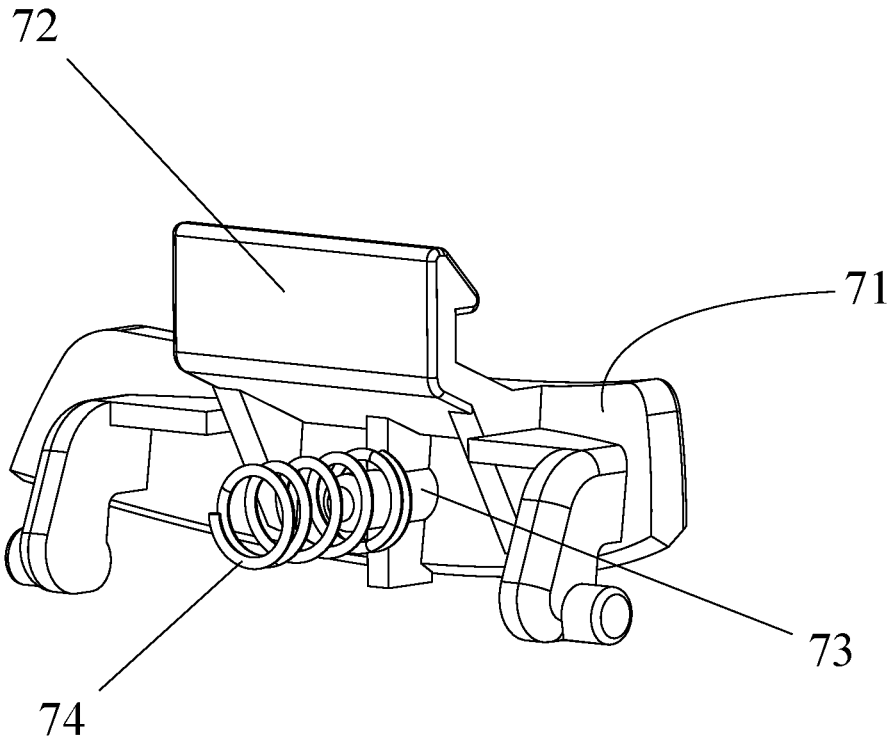
FIG. 10 is a perspective view of an exemplary locking unit constructed consistent with the invention.

To implement the locking and the unlocking of the cover member 40, a locking unit 70 is provided on the lid body 11. With reference to FIGS. 2, 4 and 10, the locking unit 70 is pivotally mounted on the lid body 11 on an opposite side to the pivotal point about which the cover member 40 pivots. The locking unit 70 comprises a locking block 72 mounted on the lid body 11 between the inner portion 112 and the outer portion 111 and engageable with a locking seat 73 arranged on the cover member 40. The locking unit 70 further comprises an operation panel 71 extending laterally from an end of the locking block 72, and a stub 73 extending from a side surface of the operation panel 71 for holding a compression spring 74. The stub 73 is arranged right beneath the blocking 72, as can be seen in FIG. 10. The compression spring 74 is held between a baffle 75 fixedly arranged on the lid body 11 and the operation panel 71. When an inward pressure onto a surface of the operation panel 71 opposite to the compression spring 74, it would cause the operation panel 71 and thus the locking block to move inward, with a result of the locking block 72 disengaging from the locking seat 73 of the cover member 40, so that the cover member 40 is switched to the unlocked position accompanied with the untwisting of the twisted passage 32.

Thus the present invention provides a lid designed for use in a container, comprising a new mechanism for blocking the fluid communication with the container. The new mechanism has a simple structure and requires no additional space.

While the present invention is described in connection with what is presently considered to be the most practical and preferred embodiment, it should be appreciated that the invention is not limited to the disclosed embodiment, and is intended to cover various modifications and equivalent arrangements included within the spirit and scope of the claims. Modifications and variations in the present invention may be made without departing from the novel aspects of the invention as defined in the claims, and this application is limited only by the scope of the claims.

What is claimed is:

1. A lid (10) connected to a container (20) for covering an opening (21) of the container (20), comprising:

a lid body (11) adapted to be removably attached to the opening (21) of the container (20), a spout unit (30) comprising a spout (31) and a passage (32) in fluid communication with the spout and with the opening (21) of the container, wherein the spout unit is mounted such that at least a part of the spout protrudes beyond the lid body (11) and the passage (32) is made of an elastic material and disposed in the lid body (11), a cover member (40) movable between a locked position wherein the cover member (40) acts on the spout unit (30) thereby pressing the spout (31) of the spout unit (30) to move downwardly, and the downward movement of the spout (31) causes twistable downward turning of the passage (32) of the spout unit (30) around a vertical central axis of the spout unit to prevent a fluid contained in the container from being dispensed through the opening (21) of the container (20), and an unlocked position wherein the action on the spout unit (30) is released, the twisted passage (32) automatically becomes untwisted due to the material elasticity thereof to resume the fluid communication of the passage (32) with the spout and the opening of the container for dispensing the fluid.

2. The lid (10) of claim 1, wherein the cover member (40) is configured to act on the spout unit (30) by pressing downwardly against the spout unit (30).

3. The lid (10) of claim 2, further comprising a guiding unit (50) configured to guide the twistable turning of the passage (32) when the spout unit (30) is pressed downwardly.

4. The lid (10) of claim 3, wherein the guiding unit (50) is secured to a bottom portion (321) of the passage (32) and configured for guiding to rotate the spout (31) about an axis thereof downwardly to activate the twistable turning of the passage (32).

5. The lid (10) of claim 4, wherein the guiding unit (50) comprises a hollow cylinder (54) with opened top and bottom ends, and a collar (55) having an upper section coupled to a bottom of the cylinder (54) and a lower section secured to the bottom portion (321) of the passage (32).

6. The lid (10) of claim 5, wherein the collar (55) has at least one positioning element (551) on an inner surface of the upper section and received in a notch (541) formed in the bottom of the cylinder (54), and at least one positioning block (552) on an inner surface of the lower section and engageable with a respective slot (323) formed on the bottom portion (322) of the passage (32); and wherein the collar (55) has internal threads for mating engagement with corresponding threads formed on an outside of the bottom of the cylinder (54) and an outside of the bottom portion (322) of the passage (32).

7. The lid (10) of claim 3, wherein a ring member (6) is sleeved onto a lower portion (312) of the spout (31), wherein interfitting male and female coupling elements are formed respectively on an inner surface of the cylinder (54) of the guiding unit (50) and on an outer surface of the ring member (60) for guiding the downward rotation of the spout (31).

8. The lid (10) of claim 7, wherein the interfitting male and female coupling elements comprise a guiding slot or a guiding step (51) formed on the inner surface of the cylinder (54) of the guiding unit (50), and at least one bulge (62) formed on the outer surface of the ring member (60) and movably received in the guiding slot or resting on the guiding step (51).

9. The lid (10) of claim 8, wherein two bulges (62) are formed opposite to each other on the outer surface of the ring member (60).

10. The lid (10) of claim 8, wherein the guiding slot or the guiding step (51) is formed spirally and circumferentially on an inner wall of the cylinder (54) of the guiding unit (50), such that when the cover member (40) acts on the spout unit (30), the bulge (62) is caused and guided to move downwardly along the guiding slot or the guiding step (51) thereby driving the downward rotation of the spout (31), which in turn causes the twistable turning of the passage (32) of the spout unit (30).

11. The lid (10) of claim 1, wherein the passage (32) of the spout unit (30) is made of an elastic material, and the elasticity allows the untwisting of the twisted passage when the action on the spout unit (30) is released.

12. The lid (10) of claim 5, wherein the lid body (11) comprises an outer portion (111), and an inner portion (112) coaxially arranged with the outer portion (111) and having a window (113) formed therethrough for receiving and engaging with a part of the cylinder (54) of the guiding unit (50), with the spout of the spout unit (30) extending beyond the window (113).

13. The lid (10) of claim 12, wherein at least one recess (53) is formed on the cylinder (54) of the guiding unit (50) to cooperate with at least one corresponding protrusion (113) formed on the inner portion (112) of the lid body (11) so as to prevent the guiding unit (50) from rotating relative to the lid body (11).

14. The lid of claim 1, wherein a locking unit (70) is pivotally mounted on the lid body (11) for locking the cover member (40) in the locked position when the locking unit is engaged with the cover member (40) and unlocking the cover member (40) when the locking unit is disengaged from the cover member.

15. The lid of claim 14, wherein the locking unit (70) comprises a locking block (72) engagble with a locking seat (73) formed on the cover member (40), an operation panel (71) extending laterally from an end of the locking block (72), and a stub (73) extending from a side surface of the operation panel (71) for holding a compression spring (74), wherein application of a pressure to the operation panel (71) enables the locking block (72) to move inward so as to disengage the locking block (72) from the locking seat (73) of the cover member (40).

16. The lid of claim 15, wherein the cover member (40) is pivotably mounted on the lid body (11) and pivotal between the locked position and the unlocked position.

17. A container assembly (1) comprising a container (20) having an opening, and a lid (10) according to claim 1 for covering the opening (21) of the container (20).

18. The lid of claim 11, wherein the elastic material is silica gel.

19. A lid (10) connected to a container (20) for covering an opening (21) of the container (20), comprising:

a lid body (11) adapted to be removably attached to the opening (21) of the container (20), a spout unit (30) comprising a spout (31) and a passage (32) in fluid communication with the spout and with the opening (21) of the container, wherein the spout unit is mounted such that at least a part of the spout protrudes beyond the lid body (11) and the passage (32) is disposed in the lid body (11), a cover member (40) movable between a locked position wherein the cover member (40) acts on the spout unit (30), thereby causing twistable turning of the passage (32) of the spout unit (30) to prevent a fluid contained in the container from being dispensed through the opening (21) of the container (20), and an unlocked position wherein the action on the spout unit (30) is released, thereby allowing untwisting of the twisted passage (32) to resume the fluid communication of the passage (32) with the spout and the opening of the container for dispensing the fluid;

wherein the cover member (40) is configured to act on the spout unit (30) by pressing downwardly against the spout unit (30);

said lid further comprising a guiding unit (50) configured to guide the twistable turning of the passage (32) when the spout unit (30) is pressed downwardly, wherein the guiding unit (50) is secured to a bottom portion (321) of the passage (32) and configured for guiding to rotate the spout (31) about an axis thereof downwardly to activate the twistable tuning of the passage (32), and further providing that the guiding unit (50) comprises a hollow cylinder (54) with opened top and bottom ends, and a collar (55) having an upper section coupled to a bottom of the cylinder (54) and a lower section secured to the bottom portion (321) of the passage (32);

wherein the collar (55) has at least one positioning element (551) on an inner surface of the upper section and received in a notch (541) formed in the bottom of the cylinder (54), and at least one positioning block (552) on an inner surface of the lower section and engageable with a respective slot (323) formed on the bottom portion (322) of the passage (32); and wherein the collar (55) has internal threads for mating engagement with corresponding threads formed on an outside of the bottom of the cylinder (54) and an outside of the bottom portion (322) of the passage (32).

20. The lid (10) of claim 19, wherein a ring member (6) is sleeved onto a lower portion (312) of the spout (31), wherein interfitting male and female coupling elements are formed respectively on an inner surface of the cylinder (54) of the guiding unit (50) and on an outer surface of the ring member (60) for guiding the downward rotation of the spout (31).

* * * * *